US006494342B1

(12) United States Patent
Wittern, III et al.

(10) Patent No.: US 6,494,342 B1
(45) Date of Patent: Dec. 17, 2002

(54) DISPENSED PRODUCT LIFT FOR VENDING MACHINE

(75) Inventors: Francis A. Wittern, III, West Des Moines, IA (US); Gary L. Walke, Bondurant, IA (US)

(73) Assignee: Inland Finance Company, Des Moines, IA (US)

( * ) Notice: Subject to any disclaimer, the term of this patent is extended or adjusted under 35 U.S.C. 154(b) by 71 days.

(21) Appl. No.: 09/697,527

(22) Filed: Oct. 26, 2000

Related U.S. Application Data

(60) Provisional application No. 60/161,648, filed on Oct. 27, 1999.

(51) Int. Cl.[7] ..... B65H 3/00

(52) U.S. Cl. ..... 221/192; 221/249

(58) Field of Search ..... 221/191, 192, 221/249, 247, 248, 213, 226, 232, 227, 230; 312/35, 352

(56) References Cited

U.S. PATENT DOCUMENTS 4,216,877 A * 8/1980 Dutvo ..... 221/213

FOREIGN PATENT DOCUMENTS

JP 405120539 A * 5/1993 ..... 221/192

* cited by examiner

*Primary Examiner*—Kenneth W. Noland
(74) *Attorney, Agent, or Firm*—McKee, Voorhees & Sease, P.L.C.

(57) ABSTRACT

An apparatus and method for lifting a dispensed product in a vending machine includes a lift member positioned in the path of a vended item. A control member, manually movable between first and second positions, raises the lift member to in turn raise a vended item.

15 Claims, 4 Drawing Sheets

DISPENSED PRODUCT LIFT FOR VENDING MACHINE

CROSS-REFERENCE TO RELATED APPLICATION

This application claims the benefit of U.S. Provisional Application Serial No. 60/161,648 filed Oct. 27, 1999.

BACKGROUND OF THE INVENTION

1. Field of the Invention

The field of the invention relates to vending machines, and in particular, to presentation of a vended item to a customer, and further in particular, to an apparatus and method for lifting a vended item after dispension.

2. Problems in the Art

Many vending machines utilize legs to support the cabinet of the machine above the floor. Such legs can elevate the cabinet several inches, for example, six inches. Many vending machines are made the conform to a uniform overall height (e.g. 72 inches). One reason is bankability--having a bank or multiple machines side-by-side and of the same size. In those cases, the volume of space in the cabinet for holding an inventory of vendible items and dispensing structure and hardware is limited accordingly.

Many vending machines utilize gravity as a part of the dispensing process. Access to the vended product is usually supplied by an opening at or near the bottom of the cabinet. Most times this requires customers to reach or bend down to retrieve a vended item. If the cabinet is elevated by legs, the access opening can usually be positioned so that it is generally not too difficult for the customer to retrieve the vended item.

Some vending machines have the access opening at a much higher position. This would reduce or even eliminate any requirement of bending or reaching down to retrieve a vended item, but would either require more complex or expensive dispensing systems, or require automated lifts (e.g. robotic) to carry a dropped/dispensed item up to a higher position for access by the customer. However, such structures add mechanical complexity and expense to the machine, as well as increased maintenance requirements.

It is therefore a principle object, feature, or advantage of the present invention to provide an apparatus and method which lifts a vended item for presentation to and access by a customer that overcomes the problems and deficiencies in the art.

A further object, feature, or advantage of the present invention is to provide an apparatus and method as above described which quickly and easily raises the product for better presentation to a customer.

Another object, feature, or advantage of the present invention is to provide an apparatus and method as above described which can improve the presentation of a product to a customer.

A still further feature, object or advantage of the present invention is to provide an apparatus and method which can, in certain instances, help a customer find a vended item.

A still further feature, object, or advantage of the present invention is the provision of an apparatus and method which can allow an increase in the internal volume of the cabinet of a vending machine.

A still further object, feature, and advantage of the present invention includes an apparatus and method which can allow increase of the internal volume of the cabinet of a bending machine and yet reduce or eliminate additional vending or downward reaching to retrieve a vended item.

Another object, feature, or advantage of the present invention is an apparatus and method which meets certain government regulations regarding access to vended products.

Another object, feature, or advantage of the present invention is an apparatus and method which is economical, noncomplex, efficient and durable.

These and other objects, features, and advantages of the present invention will become more apparent with reference to the accompanying specification and claims.

SUMMARY OF THE INVENTION

The present invention relates to a dispensed product lift for vending machines including a delivery chamber to receive a dispensed product, an access opening to the chamber for a customer, a lift member positioned to catch a vended product, and a manually movable actuator member operably connected to the lift member which can move the lift member, between a normal position and a second position raised position to lift a vended product relative to the access opening.

The method according to the present invention includes catching a vended product, and lifting the vended product in response to manual action of a customer.

A further feature of the invention includes a method of increasing the capacity of a vending machine by increasing the volume of the vending machine cabinet by lowering the bottom of the cabinet relative to the floor and lowering an access opening for customer access to vended products. Vended products are caught and lifted by manual actuation.

A further alternative feature of the present invention includes a method for improving access to a vended item of a vending machine by catching the vended item and lifting it by manual actuation for better presentation to a customer.

DETAILED DESCRIPTION OF THE PREFERRED EMBODIMENT

Figure 1:
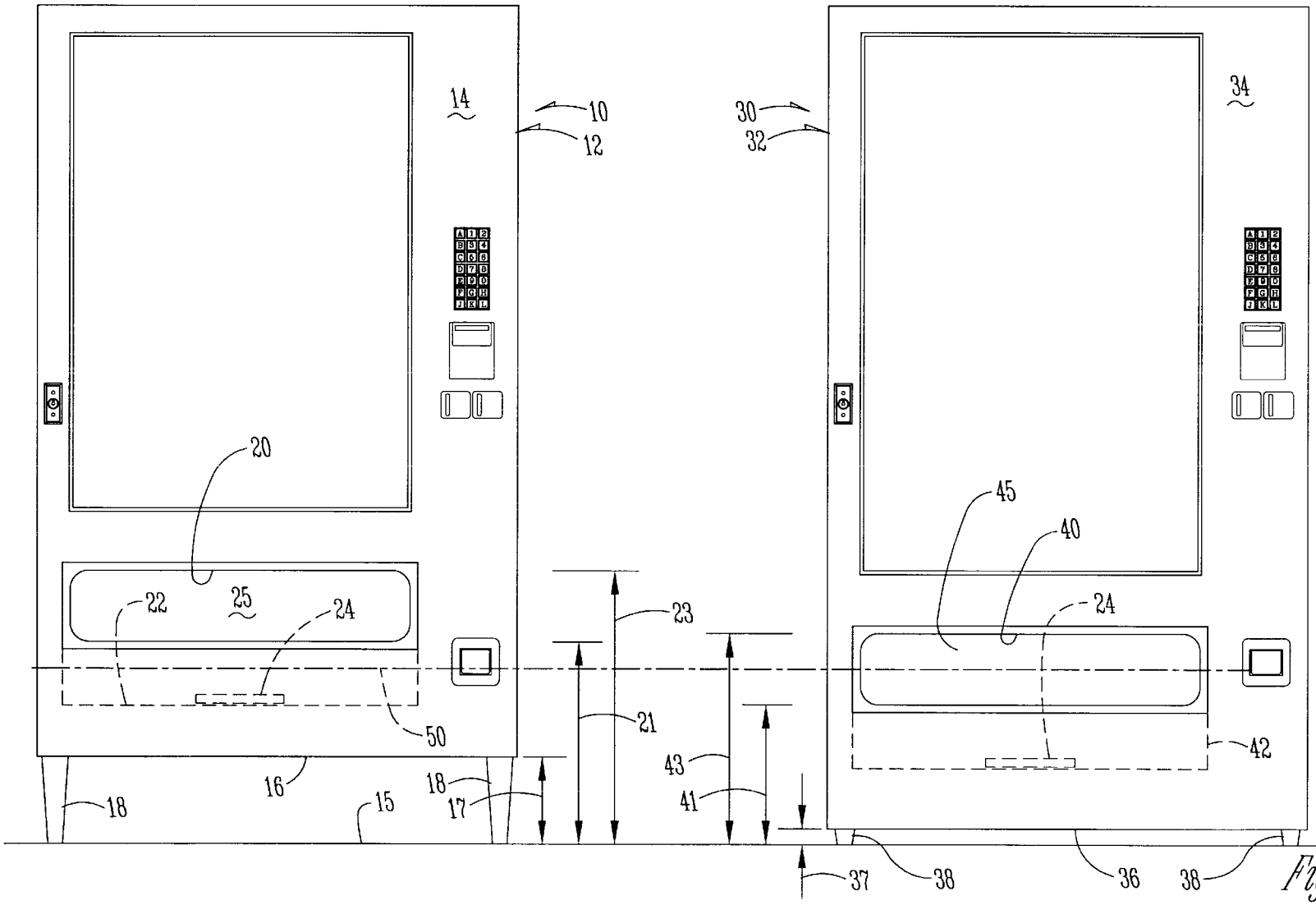
FIG. 1 is a front elevational view of a prior art vending machine on the left and a vending machine according to a one embodiment of the present invention on the right.

In order to gain a better understanding of the invention, an embodiment of the invention will now be described in detail. Frequent reference will be taken to the drawings. Reference numbers will be used to indicate certain parts and locations in the drawings. The same reference numbers will be used to indicate the same parts and locations throughout the drawings, unless otherwise indicated.

The embodiment will be described in relationship to a conventional snack vending machine such as dispenses a variety of snack-sized candy or food items. The dispensing system relies in part on gravity and therefore the access opening for the customer to retrieve a vended item is placed towards the bottom of the cabinet.

It is to be understood, however, that the present invention is applicable to other types of vending machines. The particular dispension system is not material to the invention and therefore will not be described herein.

FIG. 1 illustrates a conventional prior art vending machine 10 side-by-side with a vending machine 30 according to the present invention. Both machines have a cabinet (12 and 32 respectively) each of which defines a volume of space that is filled up with an inventory of candy or food items for vending, dispensing mechanisms and apparatus, and other conventional components of vending machines such as trays, money/taken receivers and changers, and selection mechanisms.

Many conventional vending machines have legs 18 which elevate the bottom 16 of cabinet 12 above the ground 15. This can be on the order of 6 inches as is diagrammatically (not to scale) illustrated in FIG. 1 with machine 10. To maximize internal space useable for an inventory of vendible products, access opening 20 is placed near bottom 16 of the face 14 of vending machine cabinet 12.

A delivery box assembly 22, a bin for receipt a vendible products dispensed from machine 10 (shown in ghost lines 22), is mounted in cabinet 12 in a position which catches any vended item 24. An opaque, metal delivery door 25 (alternatively plastic and/or transparent) is placed behind access opening 20.

The customer pushes open door 25 to unblock opening 20 and reaches into bin 22 to retrieve item 24. Door 25 is biased to return back (by gravity) to cover opening 20 once item 24 is located and removed, and door 25 is released by the customer.

In comparison, vending machine 30 is identical to vending machine 10 except as follows. Cabinet 32 has an increased interior volume. Legs 38 are much shorter than legs 18 of machine 10. Therefore cabinet 32 can be expanded downwardly even though vertical height is the same as machine 10. If legs 38 are, for example, approximately 1 inch tall, this can expand cabinet 32 by five inches in vertical height. This could add one or more additional trays or shelves that can be held in machine 32. This not only can increase inventory, but also the number of possible selections of products in machine 32. This would be extremely advantageous because the machine would have to be restocked less frequency, which is a time saver for the operator of the machine. It is also less likely to run out of vendible products, making customers happier. It also can present more choices to customers.

To maximize inventory capacity, access opening 40 in front face 34 of machine 30 is positioned lower than access opening 20 of machine 10. Additionally, delivery box 42 is lower than delivery box 22 of machine 10. Consequently, vended product 24 would come to rest a lower vertical position in machine 30 than in machine 10.

As shown in FIG. 1, the vertical height of bottom 16 of machine 10 is greater (see reference numeral 17) then bottom 36 in machine 30 (see reference numeral 37). The positioning of access opening 40 is also lower in machine 30 than access opening 20 of machine 10 (compare reference numerals 21/23 with 41/43).

Machine 30 therefore would present a lower, and more difficult, presentation for a customer to locate and retrieve a vended item. A specific example of why this can be important is as follows.

Government regulations exist regarding minimum vertical height for access by a person in a wheelchair to a vended product. A minimum of 9 inches above the ground exists for a person reaching sideways from a wheelchair, and 15 inches from the ground if the person is reaching forwardly from a wheelchair. As indicated generally at line 50 in FIG. 1, vending machine 10 would qualify if line 50 represented the minimum vertical height. Vending machine 30 would not. Therefore, machine 30 utilizes a dispensed or vended product lift mechanism that lifts a vended product after dispension.

FIGS. 2–5 illustrate the specific structure of the dispensed product lift mechanism. Front face 34 of machine cabinet 32 of vending machine 30 is illustrated. Opening 40 in face 34 of machine cabinet 30 is shown. Delivery box assembly 42 is behind face 34 and has a lower floor 52 which is underneath the lowest edge of opening 40.

A delivery or access door 45 is pivotally positioned behind access opening 40. Pivot axle 60 allows door 45 to pivot between a normal position generally horizontally aligned directly behind opening 40 (see FIG. 2), to a rearwardly and upwardly rotated position (see FIG. 3), which opens access to the interior of box 42.

What will be called an anti-cheat member 56 is positioned in the rear of box 42 and pivots around a pivot axle 68 that is spaced apart but generally parallel to pivot axle 60. Anti-cheat member 56 has a normal position hanging generally vertically straight down (see FIG. 2), but pivots forwardly and upwardly to the position shown in FIG. 3.

Anti-cheat member 56 serves to prevent a person from trying to extend their hand or arm, or a wire or other device, through and out of box 42 and attempt to cause unauthorized removal of items from the remainder of the vendible product inventory in cabinet 32.

Figure 4:
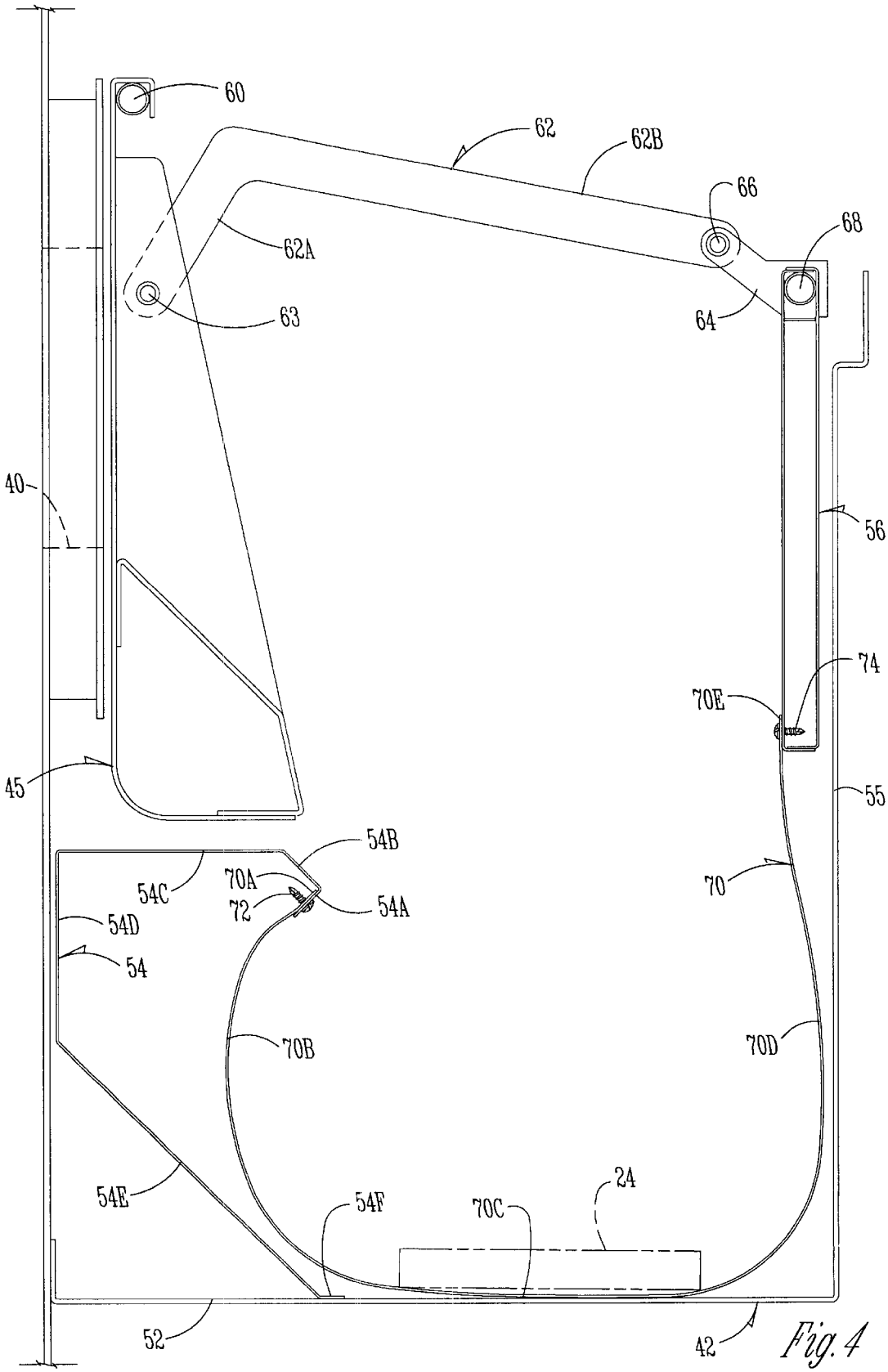
FIG. 4 is a still further enlarged side elevational view of FIG. 2.
Figure 5:
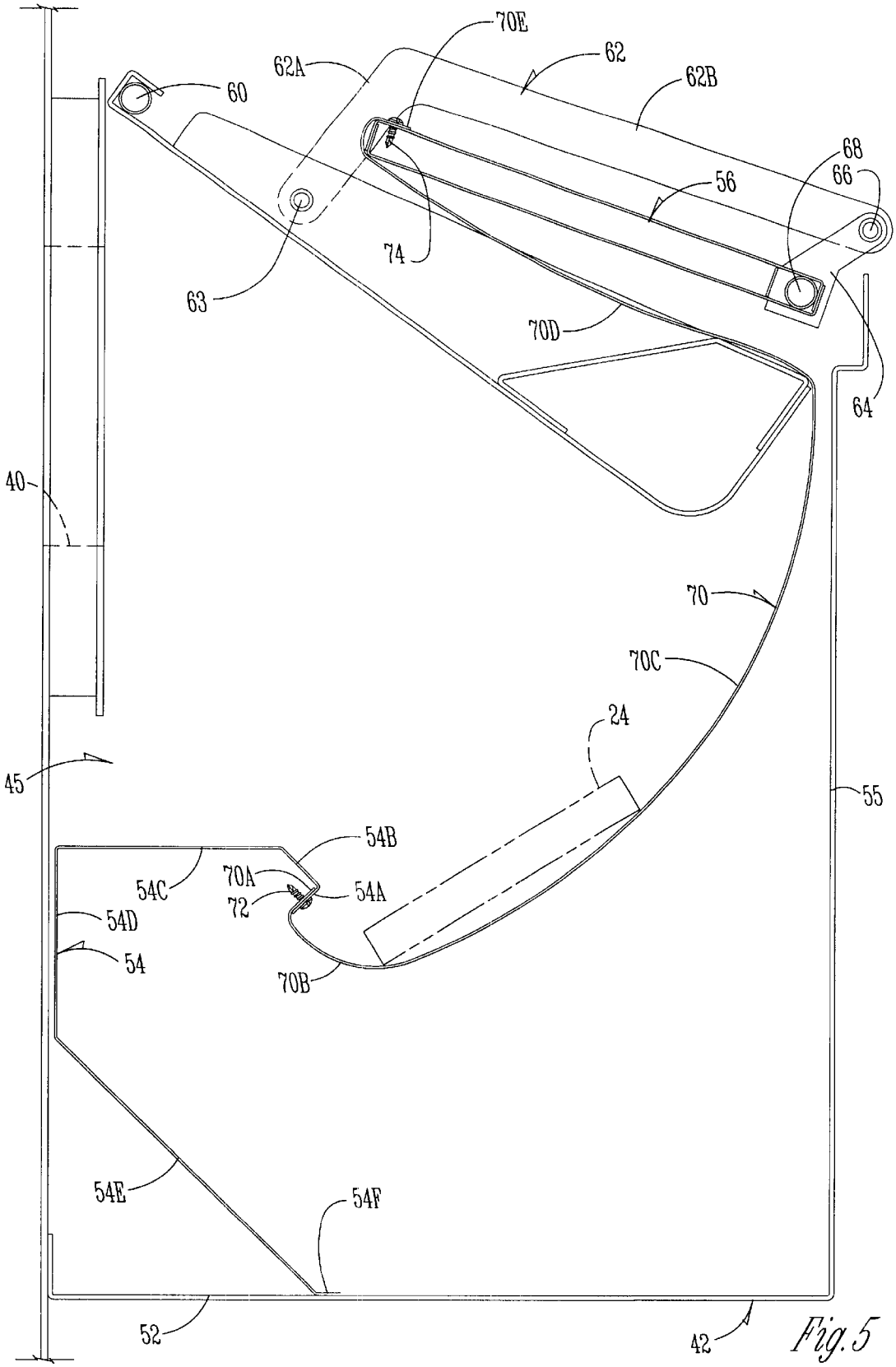
FIG. 5 is a still further enlarged side elevational view of FIG. 3.

As shown most clearly in FIGS. 4 and 5, anti-cheat member 56 moves in response to movement of access door 45. Identical linkages on opposite sides of door 45 and anti-cheat member 56 connect anti-cheat 56 and door 45. Each linkage includes an L-arm 62 pivotally connected at one end to a side 47 of door 45 at pivot connection 63, and pivotally connected at an opposite end to small arm 64 at pivot connection 66. Small arm 64 is connected to anti-cheat 56 at side 57 so that it moves with anti-cheat 56.

What is called a lift sheet 70 is connected along a rear edge 70E (see FIGS. 4 and 5) to the lower free edge of anti-cheat 56 by screws 74, and connected along its opposite edge 70A to edge 54A on false box 54 of box 42. In a normal position, lift sheet 70 roughly follows the shape of box 42 (see FIGS. 2 and 4). This allows a vended item 24 to fall to the bottom of box 42 but be caught by or land on lift sheet 70.

Figure 2:
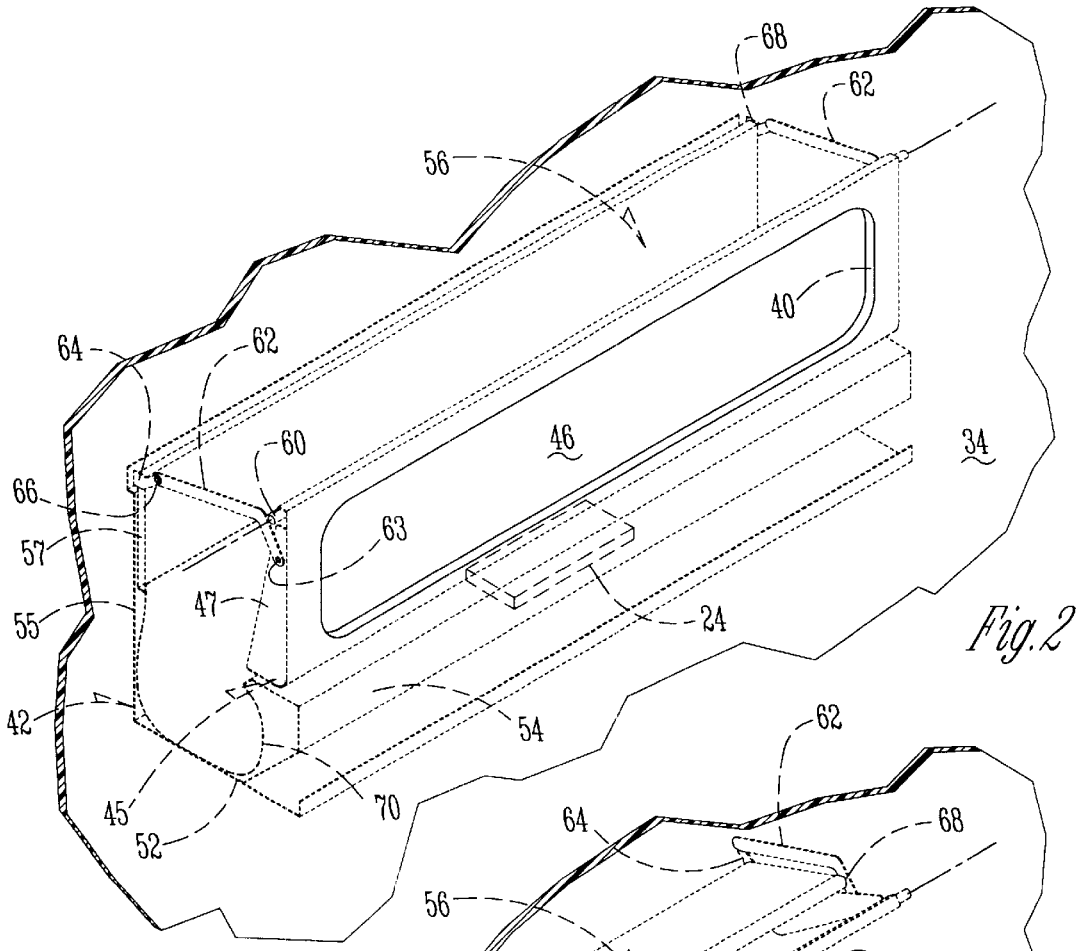
FIG. 2 is an enlarged isolated perspective view of a delivery box assembly, access opening, and lift mechanism according to an embodiment of the present invention, showing the lift mechanism in its normal state.
Figure 3:
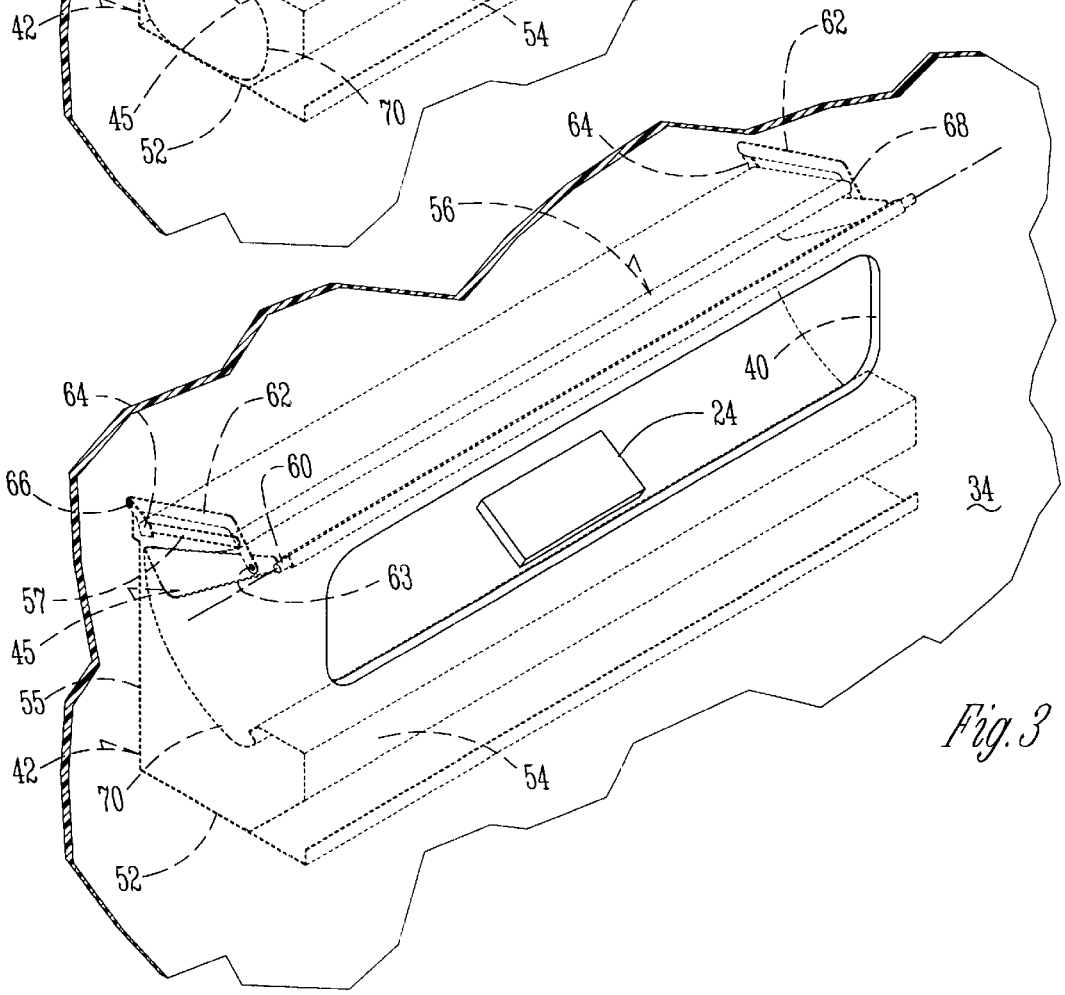
FIG. 3 is the same as FIG. 2 except showing the lift mechanism in a raised state.

FIGS. 3 and 5 illustrate how vended item 24 can be lifted for better presentation to a customer. Once item 24 is dispensed and falls to the bottom of box 42 (see FIGS. 2 and 4), it is ready to be accessed and removed by the customer. The customer must push delivery door 45 inwardly around pivot axle 60 (axle 60 is pivotally mounted to box 42 or machine 30). This moves pivot connections 63 along inward and upward arcs which in turn moves L-arms 62 rearwardly and upwardly. The opposite ends of L-arms 62 push pivot connections 66 slightly upward but mostly rearwardly. This is caused by the bend and dimensions of L-arms 62. As a result, anti-cheat 56 rotates around pivot axle 68 in the following manner. The much shorter length of small arms 64 relative to L-arms 62 causes anti-cheat 56 to rotate inwardly and upwardly ahead of door 45. This pulls edge 70E of lift sheet 70 upward to the position shown in FIGS. 3 and 5. Door 45 follows anti-cheat 56, and as shown most clearly in FIG. 5, pulls portion 70D of lift sheet 70 upward to near anti-cheat 56.

As a result, lift sheet 70 assumes the position shown in FIGS. 3 and 5. Referring specifically to FIG. 5, this position of lift sheet 70 causes item 24 to move upwardly and closer to opening 40. Item 24 is no longer at the bottom of bin 42, but presented right at the end 54B of false box 54, in plain view of the customer for much better location and grasping.

Upon release of door 45, which by gravity would pivot back to its position of FIGS. 2 and 4, lift sheet 70 would return back to its position shown in FIGS. 2 and 4, ready for the next item to be dispensed.

As can appreciated, this arrangement not only moves a vended item closer to access opening 40, but lifts it a significant amount. This can make what otherwise might not qualify as a minimum vertical height for access to a vended product into one that does meet such an indicated minimum vertical height. Still further, it should be emphasized, that lift sheet 70 can help a customer more quickly find where the vended product is located in the bin 42, saving the customer from groping, without direct view, to find the item. The precise relationship of the components described herein can vary according to choice. The components of FIGS. 2–5 are drawn generally to scale relative to one another.

This included preferred embodiment is given by way of example only, and not by way of limitation to the invention, which is solely described by the claims herein. Variations obvious one skilled in art will be included within the invention defined by the claims.

For example, lift sheet 70 is a five mil thick polycarbonate or Lexan™ sheet. This is light weight yet provides sufficient strength (it can even be used with cans and bottles and other items that are vendible from these types of machines), and the flexibility needed to fold and move in the manner described above. Other materials could be used, however. However, the lifting member could alternatively be rigid or semi-rigid, or a net, or of another configuration or combinations of configurations.

The precise configuration of the box 42 can vary according to different vending machines and needs. Different configurations of shape, attachment and size of lift sheets 70, as well as the other components of the lift mechanism, can be made.

Still further, it is not necessarily the case that a door 45 is needed. A small lever, or handle could instead be grasped and pushed (or even pulled) by a customer to cause movement of a lift sheet 70 or other like member to raise a vended product.

Still further, an anti-cheat 56 is not necessary. Again, appropriate linkage between a manually moved actuating linkage and the rear edge of a lift sheet or member can be configured which would cause the lifting of a lift sheet or member and the corresponding lifting of a vended product in or on the lift sheet or member.

It is to be understood that the present invention can be used in a variety of situations to lift a vended product or to assist in a better presentation of a vended product to an access opening of a vending machine. Still further, the lift mechanism could be advantageously used to increase the interior volume or capacity of conventional vending machines by moving the dispensing system lower in the cabinet of the vending machine and yet help present the vending product at a reasonable vertical height. Still further, the present invention can be utilized to convert a vending machine that does not otherwise meet minimum vertical presentation heights for vendible product into a machine that does so. Also, the present invention can be utilized to simply make it easier to locate a vended product within the delivery box for easier and quicker access by a customer.

What is claimed is:

1. A dispensed product lift for a vending machine comprising:

delivery chamber defining a vendible item delivery area;

a lift member positioned in the vendible item delivery area movable between a lower position and a raised position by connection to a mechanically actuated linkage, wherein the lower position comprises a first state where the lift member is positioned along contours of the chamber, and the raised position comprises a second state where the lift member is moved upwardly.

2. The apparatus of claim 1 wherein the lift member has an inner end and an outer end, the inner end being connected to the portion of the chamber near an access opening for a customer.

3. The apparatus of claim 1 further comprising linkage which moves the lift member upwardly and towards the front of the chamber in the second state.

4. A dispensed product lift for a vending machine comprising:

a delivery chamber defining a vendible item delivery area;

a lift member positioned in the vendible item delivery area movable between a lower position and a raised position by connection to a mechanically actuated linkage, wherein the lift member is connected to a control lever, the control lever moveable between first and second positions, the first position corresponding to a first state of the lift member and the second position corresponding to a second state of the lift member.

5. The apparatus of claim 4 wherein the lift member is connected to the chamber at or near an inner side of the chamber.

6. The apparatus of claim 4 wherein the control lever comprises an arm extending between the lift member and a door moveable positioned at the front of the chamber.

7. The apparatus of claim 6 wherein said linkage is connected between the door and the lift member.

8. The apparatus of claim 7 further comprising an anti-cheat member mounted in the chamber and connected to the linkage.

9. The apparatus of claim 8 wherein the anti-cheat member is also connected to the lift member.

10. A dispensed product lift for a vending machine comprising:

a delivery chamber defining a vendible item delivery area;

a lift member positioned in the vendible item delivery area movable between a lower position and a raised position by connection to a mechanically actuated linkage, wherein the lift member comprises a sheet of material.

11. The apparatus of claim 10 wherein the sheet is a flexible sheet.

12. The apparatus of claim 11 wherein the flexible sheet is relatively high strength.

13. A dispensed product lift for a vending machine comprising:

a delivery chamber defining a vendible item delivery area;

a lift member positioned in the vendible item delivery area movable between a lower position and a raised position by connection to a mechanically actuated linkage;

further comprising a door pivotally moveable relative to the chamber between a first position generally vertical in the front of the chamber and a second position upwardly and rearwardly relative to the chamber;

an anti-cheat member pivotally moveable in the chamber between first position generally vertical in the back of the chamber to a second position upwardly and forwardly relative to the chamber;

the linkage connected between the door and the anti-cheat member, movement of the door towards a second position causing movement of the anti-cheat towards a second position;

the lift member attached at or near the front of the chamber and to the anti-cheat member;

so that the anti-cheat member lifts the lift member upon movement of the door towards the second position.

14. The apparatus of claim 13 wherein the lift member comprises a flexible sheet.

15. A vending machine comprising:

a cabinet with a front wall;

a dispensing mechanism;

a controller;

a product dispension box near said front wall;

a dispension path between a vendible product and the product delivery box;

an opening in the wall for access to the interior of the box;

a catching member across the box in the dispensing path;

the catching member movable between a lower and upper positions in response to movement of a manually activated actuator member.

* * * * *

UNITED STATES PATENT AND TRADEMARK OFFICE

CERTIFICATE OF CORRECTION

PATENT NO. : 6,949,342 B2
DATED : September 27, 2005
INVENTOR(S) : Golub et al.

It is certified that error appears in the above-identified patent and that said Letters Patent is hereby corrected as shown below:

Column 44,
Line 58, “Hs.753109” should read -- Hs.75309 --.
Line 67, “Hs.I 117950” should read -- Hs.117950 --.

Column 45,
Line 23, “Hs.06673” should read -- Hs.106673 --.
Line 41, “Hs.S81622” should read -- Hs.816221 --.
Line 43, “Hs.S4651” should read -- Hs.54651 --.
Line 43, “Hs.I 18397” should read -- Hs.118397 --.

Signed and Sealed this

Thirty-first Day of January, 2006

JON W. DUDAS
*Director of the United States Patent and Trademark Office*